US006713015B1

(12) United States Patent
Toncelli et al.

(10) Patent No.: US 6,713,015 B1
(45) Date of Patent: Mar. 30, 2004

(54) METHOD FOR THE PRODUCTION OF SLABS OF CERAMIC MATERIAL

(76) Inventors: Marcello Toncelli, deceased, late of Bassano del Grappa (IT); by Luca Toncelli, legal representative, Viale Asiago, n. 34, Bassano del Grappa (Vicenza) (IT); by Dario Toncelli, legal representative, Via San Pancrazio, n. 3, Bassano del Grappa (Vicenza) (IT); by Maria Luisa Salvalaggio, legal representative, Via Papa Giovanni XXIII, n. 2, Bassano del Grappa (Vicenza) (IT)

( * ) Notice: Subject to any disclaimer, the term of this patent is extended or adjusted under 35 U.S.C. 154(b) by 0 days.

(21) Appl. No.: 10/031,552

(22) PCT Filed: Aug. 31, 2000

(86) PCT No.: PCT/EP00/08531

§ 371 (c)(1),
(2), (4) Date: Jan. 18, 2002

(87) PCT Pub. No.: WO01/17741

PCT Pub. Date: Mar. 15, 2001

(30) Foreign Application Priority Data

Sep. 3, 1999 (IT) ..... TV99A0095

(51) Int. Cl.[7] ..... B28B 1/26

(52) U.S. Cl. ..... 264/660; 267/671

(58) Field of Search ..... 264/660, 671

(56) References Cited

U.S. PATENT DOCUMENTS

| | | | | |
|---|---|---|---|---|
| 3,628,989 | A | * | 12/1971 | Solmi |
| 3,959,422 | A | * | 5/1976 | Wilhelm |
| 5,264,168 | A | | 11/1993 | Toncelli |

FOREIGN PATENT DOCUMENTS

| | | | |
|---|---|---|---|
| GB | 2 151 533 | A | 7/1985 |
| WO | WO 98 46543 | A | 10/1998 |

* cited by examiner

*Primary Examiner*—Christopher A. Fiorilla
(74) *Attorney, Agent, or Firm*—Katten Muchin Zavis Rosenman

(57) ABSTRACT

In an improved method for the production of slabs of ceramic material the starting mixture is enclosed between two sheets of cardboard or paperboard, subjected to vibrating compression under vacuum. The aboard or paperboard being thick enough to absorb the excess mixture water prior to the transfer to the subsequent drying and firing stages, said sheets of paperboard being removed before said drying stage, so that the rough-formed slab is dried resting solely on a porous fabric or felt, and baking is performed while keeping the dried rough-formed slab in contact with the oven surface solely by means of a temporary protective layer of refractory material (engobe).

5 Claims, No Drawings

METHOD FOR THE PRODUCTION OF SLABS OF CERAMIC MATERIAL

The present invention relates to a method for the manufacture of slabs of ceramic material and, more specifically, to an improvement relating to the method and plant described, illustrated and claimed in Italian patent No. 1,293,176 filed on Apr. 15, 1997(corresponding to WOA-9846453) of the same applicant.

The slabs of ceramic material to which both the method according to the present invention and that of the above mentioned patent refer are the subject of U.S. Pat. No. 5,264,168and manufactured from a ceramic mixture consisting of a granulate complying with specific parameters as regards particle size and of a binding phase which a special composition characteristics and for the details of which reference should be made to the text of the aforementioned U.S. patent.

During the implementation of said method it was noted that some stages posed certain problems as regards an industrial production, said problems having been solved with the method and plant according to the above mentioned Italian patent.

This latter method and plant envisaged the following operations:

1. Depositing a layer of fabric (felt) onto the moulding support;
2. Arranging a sheet of a paper permeable to water vapour on top of the fabric layer,
3. Deposing the ceramic mixture onto the sheet of paper, if necessary in two separate stages with insertion, after the first stage, of a mesh of reinforcing material to be embedded in the slab body;
4. Depositing a sheet of rubber onto the layer of mixture;
5. Vibrating compression under vacuum performed above the rubber sheet;
6. Removal of the rubber sheet;
7. Transfer of the "virgin" slab onto a metal-grid support by means of pincer means gripping the edge of the felt;
8. Drying treatment of the slab;
9. Raising of the dried slab and removal of the fabric layer,
10. Applying a layer of refractory material (engobe) onto the upper surface of the dried slab (previously lined with the rubber sheet) and drying thereof,
11. Overturning the slab so that it rests on the engobe-lined surface and introduction into the firing kiln, with simultaneous burning of the paper sheet still adhering to the now visible surface of the dried slab.

The slab thus obtained then undergoes the usual finishing operations, such as sizing, polishing, etc.

A major problem during this production process has been that of performing drying of the slab after the moulding phase (namely after vibrating compression under vacuum) in a rapid and as homogeneous as possible manner.

It is obvious that, in order to achieve this object, the surface of the moulded slab must be as free as possible and therefore exposed to the action of the drying means (for example hot air). However, the "virgin" slab is necessarily formed on a support capable of withstanding a vibrating compression and cannot be harped before, because of drying it reaches a sufficient degree of rigidity so as to become self-supporting at least for performing the albeit minor handling operations required in order to convey it to the final firing stage.

For this reason, the technology applied hitherto and described in the aforementioned Italian patent uses a layer of fabric or felt which allows the passage of the water vapour from the mixture and a sheet of paper arranged between felt and mixture, said sheet performing multiple functions, namely:

(i) physically separating the mixture from the felt or fabric;

(ii) absorbing excess water, which is mainly naturally expelled from the mixture layer during the vibrating compression stage, and (iii) preventing the formation of folds which are also due to the mixture water and which could red in bending of the final slab.

For this reason, the method according to the above mentioned Italian patent uses a thin sheet of paper permeable to water vapour which is arranged above a layer of fabric, preferably felt, which also performs the function of absorbing and allowing the water to pass through during drying.

In the practical implementation of this method, the thin sheet of paper, which is completely saturated with water, is preferably treated so that, after drying, it does not form folds which could damage the final slab.

It has now been found, and accordingly is the subject of the present invention, that, by modifying certain stages of the above mentioned method and altering the nature of one of the elements used in the said method, the latter is substantially improved.

These modifications consist mainly in replacing the thin sheet of treated paper with a sheet of paper of considerable thickness, which is usually classified as cardboard or paperboard, depending on the thickness and use, so as to absorb all the excess water without forming folds after vacuum vibro-compression and the drying stage. Herebelow, for the sake of simplicity, this sheet will be simply referred to as "paperboard".

The present invention therefore in its most general definition consists of a method for the production of slabs of ceramic material, of the type in which a mixture of a granulated material and a water-based binder, deposited in a metered quantity on a temporary support, undergoes a stage of vibrating compression under vacuum, followed by a drying stage during which the vibro-compressed mixture is supported by a porous material, and a firing stage, during which the dried slab rests on the firing surface by means of a temporary protective layer of refractory material (engobe), characterised in that said mixture, prior to the stage of vibrating compression under vacuum, is enclosed between two sheets, respectively a first sheet and second sheet, of cardboard or paperboard of sufficient thickness for absorbing the excess mixture water, said sheets being removed prior to said drying stage.

Therefore, the method according to Italian patent 1,293,176 is modified by envisaging the following operations:

1. Depositing a temporary support layer onto the moulding support,
2. Arranging, on top of the temporary support layer, a first sheet of paperboard of suitable thickness for absorbing the excess mixture water,
3. Depositing the ceramic mixture onto the sheet of paper, if necessary in two separate stages with insertion, after the first stage, of a mesh of reinforcing material to be embedded in the slab body;
4. Depositing a second sheet of paperboard, similar to the said first sheet according to step (3), onto the mixture layer;

5. Vibrating compression under vacuum performed above said second sheet of paperboard;
6. Removal of the second sheet of paperboard which is replaced with a layer of porous felt or other material permeable to water vapour in the form of a cloth;
7. Overturn the "virgin", that is rough-formed slab and removing in sequence the said temporary support layer and said first sheet of paperboard;
8. Transferring the slab onto a metal-grid support by means of pincer means gripping the edge of the porous felt or permeable cloth;
9. Drying treatment of the slab while resting on the said grid by means of the porous felt or permeable cloth,
10. Raising the dried slab and removing the layer of porous felt or permeable cloth;
11. Applying a layer of refractory material (engobe) onto the upper surface of the dried slab and drying thereof,
12. Overturning the layer so that it rests on the engobe-lined surface and introduction into the firing kiln.

Comparing this method with the above summarized method according to Italian patent1,293,176 it is easy to understand the advantages which arise therefrom and which may be summed up in the following points:

Firstly, during the drying stage, the bottom surface of the rough-formed or "virgin"slab, ie. that resting on the layer of cloth or felt, is no longer lined with the thin sheet of paper permeable to water vapour which, no matter how thin in any case prevents removal of the water vapour.

Secondly, before the firing stage, both the surfaces of the dried rough-formed slab are free, therefore allowing application of the layer of refractory material to any one of the two surfaces. On the contrary in the method according to the prior Italian patent one of the surfaces of the dried slab undergoes the firing stage with a thin sheet of paper firmly adhering it, such that removal thereof is performed by means of burning during firing According to the method according to the present invention, on the other hand, it is possible to decide to which surface the engobe is to be applied. For example, if one of the two surfaces has surface defects, the engobe is applied to the other surface since it is preferable to avoid that the first surface (i.e. the surface with defects) is the surface which is visible in the finished slab and therefore prevent this surface from undergoing excessive sizing in order to eliminate the surface defects.

In the practical implementation of the present invention it has been seen that, in place of the cloth or felt support, the temporary support may also consist of rubber (such as a rubberised tape) which is intrinsically more resistant to the stress which is applied during the course of vibrating compression. In fact, as mentioned, this temporary support, at the end of the vacuum compression stage, is removed and does not interfere with the drying stage.

Moreover, a temporary rubber support, which does not come into contact with the mixture and therefore does not require any particular maintenance, may be reused a practically unlimited number of times, while the porous fabric or felt used in the previous method has a limited working life.

Finally, the cardboard or paperboard which replaces the thin layer of treated paper according to the prior art is undoubtedly less highly valued and therefore less costly.

As regards the plant described and claimed in Italian patent No. 1,293,176, it may be used to implement the method according to the invention with slight modifications, i.e. the addition of a unit for depositing a layer of porous felt or other rubber-based permeable material onto the rough-formed slab emerging from the vibrating compression under vacuum of a first unit for overturning the slab, for example by means of a pair of sandwich surfaces, downstream of the above porous felt deposition unit, and a unit for removing this porous felt downstream of the drying stage.

Although the invention has been described in relation to a preferred embodiment, it is understood that conceptually and mechanically equivalent modifications and variants are possible and may be envisaged without the scope of the following claims.

What is claimed is:

1. A method for the production of a slab of ceramic material, comprising the stages of:

(i) providing a temporary support layer and arranging on top of said temporary support layer a first sheet of cardboard or paperboard (ii) depositing in a metered quantity a mixture of a granulated material and a water-based binder on a said first sheet of cardboard or paperboard made with a porous material, (iii) applying a vibrating compression under vacuum to the mixture so as to obtain a "virgin" slab, (iv) drying the "virgin" slab while it is deposited on a second support made with a porous material so as to obtain a dried slab, (v) depositing the dried slab on a protective layer of refractory material, (vi) firing the dried slab while the slab is deposited onto said protective layer, wherein a second sheet of cardboard of paperboard is applied onto the mixture layer prior to the stage (iii) of vibrating compression under vacuum so as to have the mixture layer enclosed between two sheets of cardboard or paperboard of sufficient thickness for absorbing the excess mixture water, and wherein said first and second sheets of cardboard or paperboard are removed prior to said drying stage (iv).

2. Method for the production of a slab of ceramic material according to claim 1, wherein at be end of the stage (iii) of vibrating compression under vacuum the said second sheet of cardboard or paperboard is removed, and replaced by a cloth or felt and thereafter an additional stage (takes place in which the slab is overturned so that said cloth or felt becomes the second support made with porous material of the "virgin" slab during the drying stage (iv).

3. Method for the production of a slab of ceramic material according to claim 2, wherein the mixture is deposited not only on said first sheet of cardboard or paperboard but also on a temporary support layer positioned under said first sheet of cardboard or paperboard, and wherein said temporary support layer and said first sheet of cardboard or paperboard are removed after the said additional stage in which the slab is overturned after the stage (iii) of vibrating compression under vacuum and prior to the drying stage (iv).

4. Method for the production of a slab of ceramic material according to claim 3, wherein said temporary support layer positioned under said first sheet of cardboard or paperboard consists of one of a cloth, a felt, or a rubberized tape.

5. Method for the production of a slab of ceramic material according to claim 2, wherein after said drying stage (iv), the dried slab is raised so as to remove said second support made with a porous material.

* * * * *